United States Patent [19]

Herbert

[11] 4,333,698

[45] Jun. 8, 1982

[54] COVER FOR TRUCK/TRAILER MALE ELECTRICAL PLUG

[76] Inventor: Leroy Herbert, 70 E. 100 North, Bountiful, Utah 84010

[21] Appl. No.: 139,163

[22] Filed: Apr. 11, 1980

[51] Int. Cl.[3] ..... H01R 13/52

[52] U.S. Cl. ..... 339/36; 339/117 R

[58] Field of Search ..... 339/36–38, 339/117 R

[56] References Cited

U.S. PATENT DOCUMENTS 3,107,132 10/1963 Smith ..... 339/36

3,258,731 6/1966 Still et al. ..... 339/36

FOREIGN PATENT DOCUMENTS 2840696 3/1980 Fed. Rep. of Germany ..... 339/37

*Primary Examiner*—Joseph H. McGlynn

*Attorney, Agent, or Firm*—Thorpe, North & Western

[57] ABSTRACT

A cover for a male member truck/trailer electrical plug is disclosed for keeping the plug dry and free from moisture and other corrosive or debilitating substances. The cover includes a hollow body made of a resilient material such as rubber or neopreme. An opening is formed in one side of the body member to enable fitting the cover over the plug. A groove is formed in the interior side wall of the hollow to receive the guide rib which is formed on truck/trailer male plugs. The side of the body member opposite the opening is formed in the shape of a nob to enable grasping thereof to place on and remove the cover from the plug. A small conduit is formed in the plug to extend from the hollow of the body member through the rear wall thereof to allow escape of air when the cover is placed over the plug and the entry of air when the cover is removed from the plug.

2 Claims, 2 Drawing Figures

COVER FOR TRUCK/TRAILER MALE ELECTRICAL PLUG

BACKGROUND OF THE INVENTION

This invention relates to a cover for placement over conventional truck/trailer male electrical plugs.

Most trailers designed for towing behind a towing vehicle are required to have tail safety lamps and, in some instances, rear turn-signal lamps. To provide power to such lamps, the electrical system of the trailer is coupled to the electrical system of the towing vehicle by way of a plug arrangement. Most often, a so-called male electrical plug element is mounted on either the towing vehicle or trailer and the corresponding female electrical plug element is mounted on the trailer or towing vehicle. Then, when the trailer is hitched to the towing vehicle, the male and female elements are plugged together to provide the desired electrical connection.

When the trailer is not hitched to the towing vehicle, then, of course, both the male and female plugs are exposed to the elements and since they are typically located fairly close to the road level, they are subjected to water, dust, etc., stirred up from the road. This is especially true for the plug mounted on a towing vehicle which is driven, but even when not driven, the plugs are exposed to the elements which can cause corrosion, dirt and dust build up, etc.

SUMMARY OF THE INVENTION

It is an object of the invention to provide a simple and easy to manufacture cover for use on truck/trailer male electrical plugs.

It is another object of the invention to provide such a cover which, when placed over a plug, effectively prevents exposure of the plug to moisture or other debilitating elements.

It is a further object of the invention to provide such a cover which may readily be inserted over and removed from a plug.

The above and other objects of the invention are realized in a specific illustrative cover for use with truck/trailer male electrical plugs having a spline or ridge formed to extend longitudinally on the exterior of the plug. The cover includes a hollow body member made of a resilient material and formed with an opening in one end thereof for receiving the plug. The interior side wall dimensions of the hollow are substantially the same as the exterior side wall dimensions of the plug. The body member includes a groove formed in the interior side wall of the hollow for receiving the spline or guide ridge of the plug when the body member is placed over the plug. A small channel or conduit is formed to extend from the hollow of the body member through a wall generally opposite the location of the opening to allow escape of air when the cover is placed over the plug and to allow entry of air when the cover is removed from the plug.

In accordance with one aspect of the invention, an eyebolt is disposed in a wall of the body member opposite the opening so that the bolt portion of the eyebolt is embedded in the body member and the eyelet of the eyebolt is disposed on the exterior of the body member to allow attachment to a chain or other tether. With this latter arrangement, a small opening is formed centrally in the eyebolt to allow communication between the interior and exterior of the cover.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
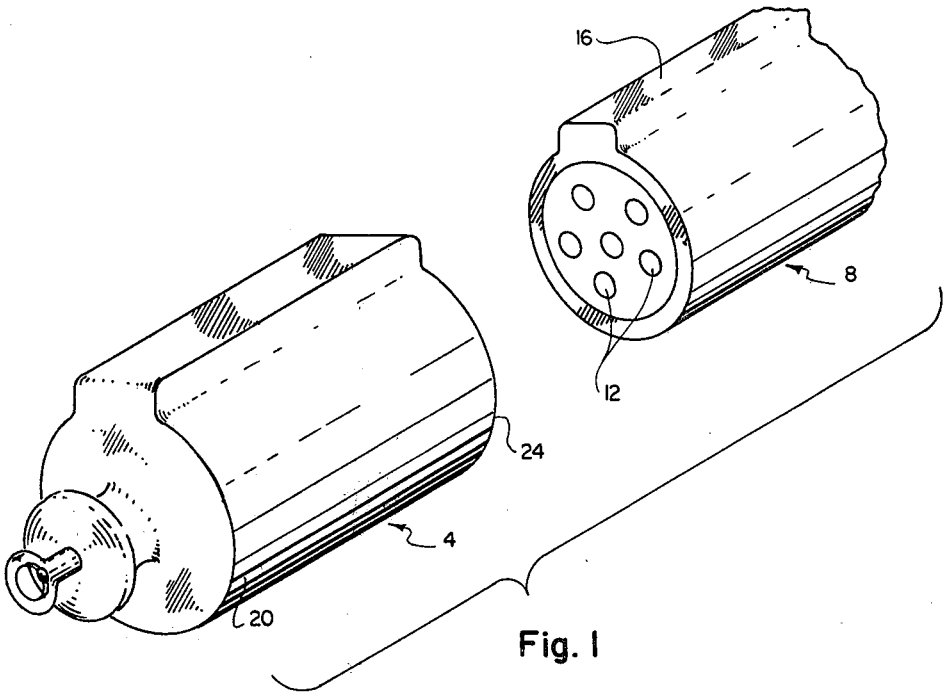
FIG. 1 is a perspective view of a cover for a truck/-trailer male electrical plug made in accordance with the principles of the present invention.

Referring to the drawings, there is shown a cover 4 for use in placement over a truck/trailer male electrical plug 8. The plug 8 typically includes electrical contact elements 12 at the front thereof and a ridge or spline 16 which is formed on the exterior of the plug to extend longitudinally thereof as shown. This spline, of course, serves as a key to ensure that the corresponding truck/-trailer female plug will be oriented properly when placed over the plug 8.

The cover 4 includes a generally elongate hollow body 20 having an opening 24 in a front end thereof and being closed at the opposite or rear end.

Formed in a side interior wall of the body member 20 is a groove 28 which extends generally longitudinally of the body member. The interior side walls of the hollow of the body member 20 and the groove 28 are dimensioned to be substantially the same as the exterior dimensions of the side wall and spline 16 of the plug 8 so that the cover will fit snuggly over the plug. In order to place the cover over the plug, of course, the groove 28 formed in the interior side wall of the body member 20 must be aligned with the spline 16 of the plug as generally shown in FIG. 1.

The body member 20 is formed of a resilient material such as rubber or neopreme so that it may be deformed if necessary when sliding it over the plug or removing it from the plug. Also, rubber, neopreme or like material displays some resistance when slid over a metal material and this characteristic tends to inhibit the plug 4 from inadvertently sliding off the plug 8.

Figure 2:
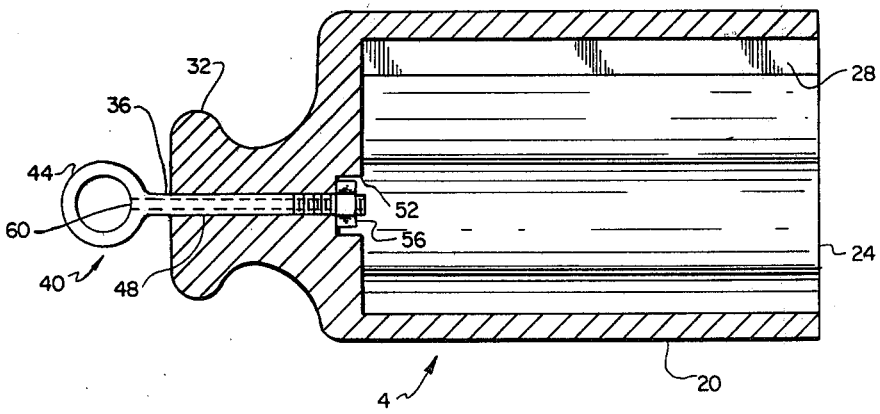
FIG. 2 is a side, cross-sectional view of the cover of FIG. 1.

Formed on the rear of the body member 20 is a knob 32 suitable for grasping in the hand to place the cover over a plug or remove the cover from a plug. A conduit or channel 36 is formed in the rear end of the body member 20 to extend from the hollow of the body member rearwardly out the end of the knob 32. An eyebolt 40, which includes an eyelet 44 and a bolt portion 48, is disposed in the channel 36 as shown in FIG. 2. The end of the eyebolt 40 protrudes a short distance into a recessed cavity 52 formed in the rear interior wall of the body member 20. A nut 56 is screwed onto the end of the eyebolt 40 to secure the eyebolt in place. The cavity 52 is recessed a sufficient depth so that the eyebolt 40 and nut 56 do not protrude into the hollow of the body member 20 when in place. Thus, no contact is made between the eyebolt 40 or nut 56 and the plug 8 when the cover is placed over the plug. A chain or other tether may be fastened to the eyelet 44 and then to some part of the truck or trailer on which the plug 8 is mounted so that the cover will not be lost.

A small channel or conduit 60 is centrally formed to extend the full length of the bolt portion 48 of the eye bolt 40. This channel or conduit enables communication between the hollow of the body member 20 with the outside so that when the cover is slid onto a plug, air can escape through the channel and when the cover is pulled from a plug, air may enter the hollow. This makes it easier to slide the cover onto and remove the cover from the plug 8.

An alternative arrangement for the eyebolt 40 would be simply to form an eyelet from the material from which the body member 20 is fabricated and then simply provide a bore extending through the knob 32 to the interior wall of the body member 20. Such a structure would also allow air to enter and escape from the hollow of the cover as it was being placed over or removed from a plug. However, the eyelet formed of the rubber, neopreme or similar material would probably not be as strong as the eyebolt 40.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A cover for a truck/trailer electrical plug which has predetermined exterior side wall demensions and a guide ridge protruding from the side wall and extending longitudinally therealong said the cover including a hollow body member made of a resilient material and formed with an opening in the front end thereof for receiving a plug, the interior sidewall deminisions of the hollow being substantially the same as the exterior side wall dimensions of the plug, said body member including a groove formed in the interior side wall of the hollow for slidingly receiving the guide ridge of the plug when the body member is placed over the plug, channel means extending from the hollow of the body member through a rear wall thereof to allow escape of air when the cover is placed over the plug, and the entry of air when the cover is removed from the plug, and an eyebolt means having an elongate bolt portion and eyelet formed at one end of the bolt portion, said eyebolt means being disposed in the rear wall of the body member with the bolt portion being imbedded in said rear wall and the eyelet being positioned outside the body member, said eyebolt means including a hollow channel formed in the bolt portion to extend the full length thereof to allow communication between the interior and exterior of the body member.

2. A cover as in claim 1 further including a recessed cavity formed in the interior surface of the rear wall of the body member about the end of the bolt portion of the eyebolt means, and a nut for screwing onto the end of the bolt portion to secure the eyebolt means in place in the rear wall of the body member, said nut being positioned in the recessed cavity when screwed onto the end of said bolt portion.

* * * * *